US010022985B2

(12) United States Patent
Sasaki

(10) Patent No.: US 10,022,985 B2
(45) Date of Patent: Jul. 17, 2018

(54) TAPE PRINTING APPARATUS

(71) Applicant: SEIKO EPSON CORPORATION, Tokyo (JP)

(72) Inventor: Taishi Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/467,620

(22) Filed: Mar. 23, 2017

(65) Prior Publication Data

US 2017/0291429 A1 Oct. 12, 2017

(30) Foreign Application Priority Data

Apr. 8, 2016 (JP) ..... 2016-078236

(51) Int. Cl.
*B41J 2/235* (2006.01)
*B41J 3/407* (2006.01)
*B41J 2/32* (2006.01)

(52) U.S. Cl.
CPC ..... *B41J 3/4073* (2013.01); *B41J 2/32* (2013.01)

(58) Field of Classification Search
CPC ..... B41J 3/36; B41J 3/46; B41J 3/4073; B41J 3/4075; B41J 2/32
USPC ..... 347/171, 222; 400/76, 88
See application file for complete search history.

(56) References Cited

U.S. PATENT DOCUMENTS

2008/0080918 A1 4/2008 Caveney et al.
2008/0085142 A1 4/2008 Caveney et al.
2009/0016795 A1 1/2009 Caveney et al.

FOREIGN PATENT DOCUMENTS

JP 2002160419 A * 6/2002
JP 04908493 B 1/2012

* cited by examiner

*Primary Examiner* — An Do
(74) *Attorney, Agent, or Firm* — Workman Nydegger

(57) ABSTRACT

A tape printing apparatus includes an operation surface and a plurality of operation keys protruding from the operation surface. The operation keys include first keys and second keys that protrude less than the first keys from the operation surface, and the second keys include at least one of a power key and a print key.

5 Claims, 2 Drawing Sheets

TAPE PRINTING APPARATUS

BACKGROUND

1. Technical Field

The present invention relates to a tape printing apparatus having a plurality of operation keys.

2. Related Art

A hand-held printer is described as an example tape printing apparatus. Some hand-held printers include a plurality of operation keys and an operation surface from which the operation keys protrude. However, in such hand-held printers, no particular attention has been paid to the height of protrusions of the operation keys with respect to the operation surface (see, for example, Japanese Patent No. 4908493).

If a user accidentally operates a power key of a tape printing apparatus during an input or edit operation of a character string to be printed, the power supply is switched off and the input or edit operation is stopped. In another case, if a user accidentally operates a print key during an input or edit operation of a character string to be printed, the print operation is executed before the input or edit operation is complete.

SUMMARY

An advantage of some aspects of the invention is that there is provided a tape printing apparatus capable of preventing users from accidentally operating at least one of a power key and a print key.

A tape printing apparatus according to an aspect of the invention includes an operation surface and a plurality of operation keys protruding from the operation surface. The operation keys include first keys and second keys that protrude less than the first keys from the operation surface, and the second keys include at least one of a power key and a print key.

With this structure, the height of the protrusions of the second keys with respect to the operation surface is lower than the height of the protrusions of the first keys with respect to the operation surface, and consequently, the second keys are touched less frequently than the first keys by a key-operating object such as a finger. Accordingly, users are prevented from accidentally operating at least one of the power key and the print key included in the second keys.

In this apparatus, it is preferable that the operation keys further include third keys that protrude more than the first keys from the operation surface, and the third keys include character keys.

With this structure, the height of the protrusions of the third keys with respect to the operation surface is higher than the height of the protrusions of the first keys with respect to the operation surface, and consequently, the third keys are touched more frequently than the first keys by a key-operating object such as a finger. Consequently, the character keys, which are included in the third keys, can be readily operated, and thereby operability in an operation of inputting a character string to be printed can be increased.

In this apparatus, it is preferable that a key top of each of the third keys be convex.

With this structure, an area where the key top of the third key comes into contact with a finger is reduced compared with a case where the key top of the third key is flat or concave. Consequently, when a user operates the third key with a finger, the user's tactile experience can be increased.

In this apparatus, it is preferable that the tape printing apparatus further include at least one of a frame member that surrounds the power key and a frame member that surrounds the print key.

With this structure, the frame member prevents a key-operating object such as a finger from pressing the power key or the print key. Accordingly, users are further effectively prevented from accidentally operating at least one of the power key and the print key.

In this apparatus, it is preferable that the tape printing apparatus be held and operated by hand.

With this structure, users are prevented from accidentally operating at least one of the power key and the print key during operation when the tape printing apparatus is held by hand.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
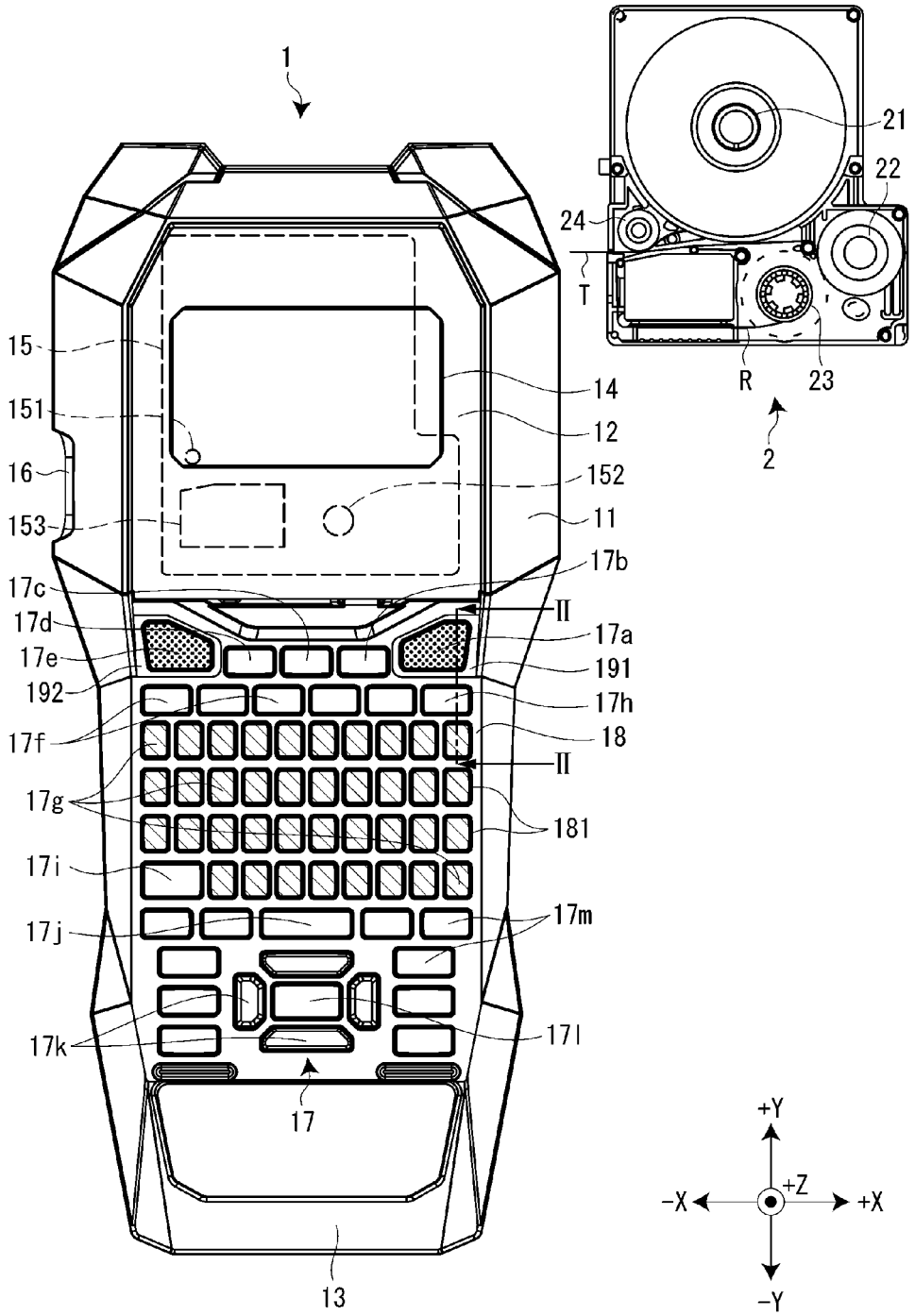
FIG. 1 illustrates a tape printer according to an embodiment of the invention and a tape cartridge to be attached thereto.

A tape printer 1 according to an embodiment of the tape printing apparatus of the invention will be described with reference to the attached drawings. To clarify the arrangement relationship of the components of the apparatus, in the drawings described below, an XYZ rectangular coordinate system is provided, however, it should be understood that this system does not limit the invention.

As illustrated in FIG. 1, the tape printer 1 has an overall oblong shape, a middle portion of which is narrow in the longitudinal direction (Y direction). A user holds the tape printer 1, from the −Z side, with one or both hands on the narrow portion, and while holding the tape printer 1, the user operates a plurality of operation keys 17, which are provided on the +Z side. In other words, the tape printer 1 can be operated while being held by a user. The operation keys 17 can be operated while the tape printer 1 is placed on a desk or the like, or while the tape printer 1 is attached to a vertical surface of a magnetic body by a magnet (not illustrated), which is attached to the −Z side of the tape printer 1. The tape printer 1 is powered through a battery attached to a battery attaching section (not illustrated) on the −Z side, or through a commercial power supply via an alternating current (AC) adapter, which is inserted into an adapter port (not illustrated) on a side surface on the +X side.

The tape printer 1 includes an apparatus case 11 and a cover 12, which are outer coverings. In the end portion of the apparatus case 11 on the −Y side, a grip section 13 is provided. The grip section 13 is held when the tape printer 1 is carried.

The cover 12 is provided on the +Z side of the apparatus case 11. The cover 12 is rotatable around an end portion of the apparatus case 11 on the +Y side. A display 14 is provided on an outer surface of the cover 12, that is, on the surface that is on the +Z side when the cover 12 is closed. The display 14 shows a character string to be printed in an edit operation, an image to be printed on a tape T, various options, or the like. A cartridge attaching section 15 appears when the cover 12 is opened. To the cartridge attaching section 15, a tape cartridge 2 is detachably attached.

The tape cartridge 2 contains a tape core 21, a ribbon feeding core 22, a ribbon winding core 23, and a platen roller 24, which are rotatable. Around the tape core 21, the tape T is wound in a rolled state. Around the ribbon feeding core 22, an ink ribbon R is wound in a rolled state. The ribbon winding core 23 winds the ink ribbon R fed from the ribbon feeding core 22. The platen roller 24 rotates while nipping the tape T and the ink ribbon R with a print head 153, which will be described below. With this structure, the tape T and the ink ribbon R are fed.

The cartridge attaching section 15 includes a platen drive shaft 151, a ribbon winding shaft 152, and the print head 153. The platen drive shaft 151 rotates the platen roller 24. The ribbon winding shaft 152 rotates the ribbon winding core 23. The print head 153 performs thermal printing onto the tape T of the tape cartridge 2. In other words, the print head 153 generates heat while the print head 153 and the platen roller 24 are nipping the tape T and the ink ribbon R therebetween. With this structure, the ink on the ink ribbon R is transferred to the tape T, and thereby printing onto the tape T is performed.

A tape discharge port 16 is provided on a side surface of the apparatus case 11 on the −X side. The printed tape T is discharged from the tape discharge port 16 when the printed surface faces the −Y direction, that is, toward the user, when the user is holding and operating the tape printer 1. A cutter (not illustrated) is provided between the cartridge attaching section 15 and the tape discharge port 16. The cutter cuts the tape T in the width direction. The printed portion of the tape T is cut by the cutter and used as a label.

The tape printer 1 includes the plurality of operation keys 17 and an operation surface 18 on which the operation keys 17 are arranged. The operation surface 18 is a surface of the apparatus case 11 on the +Z side. On the operation surface 18, a plurality of key openings 181 are provided. Through the key openings 181, corresponding operation keys 17 are provided such that individual operation keys 17 can be pressed downward. In other words, the operation keys 17 protrude from the operation surface 18 in the +Z direction (see FIG. 2).

The operation keys 17 include a power key 17*a*, a preview key 17*b*, a file key 17*c*, a feed key 17*d*, a print key 17*e*, special label keys 17*f*, character keys 17*g*, a delete key 17*h*, a shift key 17*i*, a space key 17*j*, cursor keys 17*k*, an enter key 17*l*, and edit keys 17*m*. Although not specifically illustrated, on each surface of the operation keys 17, an alphabetical character, a numeral, a symbol, or the like corresponding to each function of the operation keys 17 is shown.

The power key 17*a* is used to switch on or off the power supply of the tape printer 1. The preview key 17*b* is used to display an image to be printed on the tape T on the display 14. The file key 17*c* is used to store or retrieve data of an input or edited character string to be printed. The feed key 17*d* is used to feed the tape T and the ink ribbon R after the tape cartridge 2 has been attached to the cartridge attaching section 15. The print key 17*e* is used to execute a print operation. The special label keys 17*f* are used to create a special label.

The character keys 17*g* are used to input characters such as alphabetical characters, numerals, symbols, or the like. The delete key 17*h* is used to delete an input character. The shift key 17*i* is used to shift the functions of the operation keys 17. The space key 17*j* is used to input a space. The cursor keys 17*k* are used to move a cursor to select an option from options displayed on the display 14. The enter key 17*l* is used to enter the selected option. The edit keys 17*m* are used to edit a character that has been input by using the character key 17*g*, for example, to change the size of the font.

The operation keys 17 are substantially symmetrically arranged for convenience so that a user may perform an operation by holding the tape printer 1 with both hands and pressing the operation keys 17 with both thumbs. For example, among the operation keys 17, the power key 17*a* is provided on the +X side of the +Y surface, and the print key 17*e* is provided at a position symmetrical with respect to the power key 17*a*, that is, on the −X side of the +Y surface.

A first frame member 191 that surrounds the power key 17*a* is arranged around the power key 17*a*. The first frame member 191 reduces the chance of accidental contact with the power key 17*a*. A second frame member 192 that surrounds the print key 17*e* is arranged around the print key 17*e*. The second frame member 192 reduces the chance of accidental contact with the print key 17*e*.

It is preferable that the operation keys 17 be colored with two or more different colors to enable users to distinguish the operation keys 17 by color. For example, the print key 17*e* may be yellow-green (a fluorescent color), the preview key 17*b*, the file key 17*c*, the feed key 17*d*, and the special label keys 17*f* may be white, and the other operation keys 17 may be black. Furthermore, it is preferable that the color of the operation surface 18 be different from the colors of the operation keys 17; for example, the operation surface 18 may be red. The colors of the first frame member 191 and the second frame member 192 are not limited to a specific color and may be, for example, black.

An operation procedure of the operation keys 17 performed by a user to create a label will be briefly described. The user attaches the tape cartridge 2 to the cartridge attaching section 15, closes the cover 12, and presses the power key 17*a*, thereby switching on power supply to the tape printer 1. Then, the user presses the feed key 17*d*. With this operation, the tape T and the ink ribbon R are fed and the slack in the tape T and the ink ribbon R is taken up.

While watching the display 14, the user operates the character keys 17*g* and other keys to input or edit a character string to be printed. During the operation, the user can press the preview key 17*b* to display, on the display 14, an image of the input or edited character string to be printed onto the tape T and check the displayed image. After completing the input or edit operation of the character string to be printed, the user presses the print key 17*e*. By this operation, the input or edited character string is printed onto the tape T and the printed portion is cut off as a label.

Figure 2:
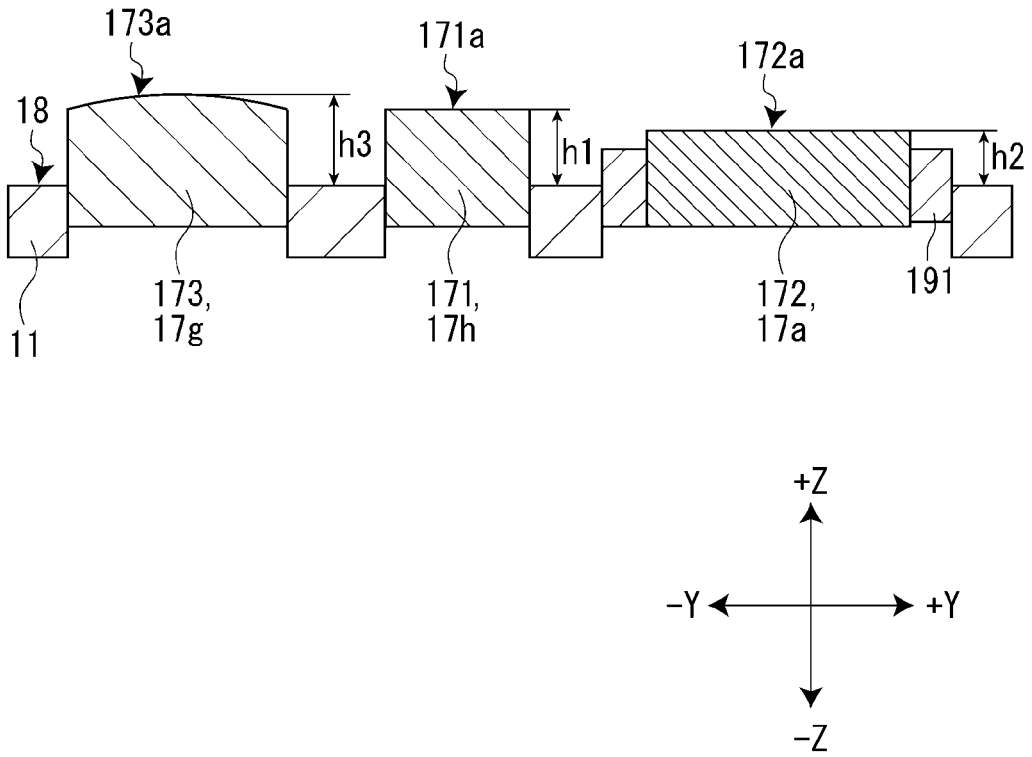
FIG. 2 is a schematic cross-sectional view taken along line II-II in FIG. 1.

With reference to FIG. 2, the height of protrusions of the operation keys 17 with respect to the operation surface 18 will be described. The operation keys 17 are classified as first keys 171, second keys 172, and third keys 173 according to differences in the heights of the protrusions with respect to the operation surface 18.

The second keys 172 include the power key 17*a* and the print key 17*e*. The third keys 173 include the character keys 17*g*. The first keys 171 include the operation keys 17 other than the power key 17*a*, the print key 17*e*, and the character keys 17*g*. In FIG. 1, for the sake of convenience, the operation keys 17 included in the second keys 172 are indicated by a dotted pattern, the operation keys 17 included in the third keys 173 are indicated by a diagonally shaded pattern, and the operation keys 17 included in the first keys 171 are not indicated by any pattern. It should be noted that it is not necessary to apply such patterns to the actual operation keys 17.

The height of the protrusions of the second keys 172 with respect to the operation surface 18 is lower than that of the first keys 171 with respect of to the operation surface 18. The height of the protrusions of the third keys 173 with respect to the operation surface 18 is higher than that of the first keys 171 with respect to the operation surface 18. In other words, if h1 denotes the height of the protrusions of the first keys 171 with respect to the operation surface 18, h2 denotes the height of the protrusions of the second keys 172 with respect to the operation surface 18, and h3 denotes the height of the protrusions of the third keys 173 with respect to the operation surface 18, h2<h1<h3. Since the height (h2) of the protrusions of the second keys 172 with respect to the operation surface 18 is lower than the height (h1) of the protrusions of the first keys 171 with respect to the operation surface 18, the second keys 172 are touched less frequently than the first keys 171 by a key-operating object such as a finger. Moreover, since the height (h3) of the protrusions of the third keys 173 with respect to the operation surface 18 is higher than the height (h1) of the protrusions of the first keys 171 with respect to the operation surface 18, the third keys 173 are touched more frequently than the first keys 171 by a key-operating object.

The height of the protrusion of the first frame member 191 with respect to the operation surface 18 is lower than the height (h2) of the protrusion of the power key 17*a*, which is surrounded by the first frame member 191, with respect to the operation surface 18. Similarly, the height of the protrusion of the second frame member 192 with respect to the operation surface 18 is lower than the height (h2) of the protrusion of the print key 17*e*, which is surrounded by the second frame member 192, with respect to the operation surface 18.

A surface of the first key 171 on the +Z side, that is, a first top surface 171*a*, which is a key top of the first key 171, is flat. Similarly, a surface of the second key 172 on the +Z side, that is, a second top surface 172*a*, which is a key top of the second key 172, is flat. On the other hand, a surface of the third key 173 on the +Z side, that is, a third top surface 173*a*, which is a key top of the third key 173, is convex, that is, a curved surface that curves outward in the +Z direction. With this form, an area where the third top surface 173*a* comes into contact with a finger is reduced compared with a case where the third top surface 173*a* is flat or concave. In another case, when a user holds and operates the tape printer 1 by hand, the user sometimes selects an operation key 17 by moving their thumb approximately parallel to the operation surface 18. In such a case, the thumb that moves approximately parallel to the operation surface 18 readily touches the peak of the convex curved surface of the third top surface 173*a*, which increases the tactile experience. The difference between the height (h3) of the protrusion of the third key 173 with respect to the operation surface 18 and the height (h1) of the protrusion of the first key 171 with respect to the operation surface 18 corresponds approximately to the amount of the protrusion of the third top surface 173*a*, which is convex.

As described above, the tape printer 1 according to the embodiment includes the operation surface 18 and the operation keys 17, which protrude from the operation surface 18. The operation keys 17 include the first keys 171 and the second keys 172, which have the protruding height with respect to the operation surface 18 lower than that of the first keys 171. The second keys 172 include the power key 17*a* and the print key 17*e*.

With this structure, the height (h2) of the protrusions of the second keys 172 with respect to the operation surface 18 is lower than the height (h1) of the protrusions of the first keys 171 with respect to the operation surface 18, and consequently, the second keys 172 are touched less frequently than the first keys 171 by a key-operating object. Accordingly, users are prevented from accidentally pressing and operating the power key 17*a* and the print key 17*e* included in the second keys 172. As a result, users are prevented from accidentally operating the power key 17*a* during an input or edit operation of a character string to be printed and from accidentally switching off the power and stopping the input or edit operation. Furthermore, users are prevented from accidentally operating the print key 17*e* during an input or edit operation of a character string to be printed and from accidentally executing the print operation before the input or edit operation is complete.

In the tape printer 1 according to the embodiment, the operation keys 17 include the third keys 173, which have the protruding height with respect to the operation surface 18 higher than that of the first keys 171. The third keys 173 include the character keys 17*g*.

With this structure, the height (h3) of the protrusions of the third keys 173 with respect to the operation surface 18 is higher than the height (h1) of the protrusions of the first keys 171 with respect to the operation surface 18, and consequently, the third keys 173 are touched more frequently than the first keys 171 by a key-operating object. Consequently, the character keys 17*g* that are included in the third keys 173 can be readily operated, and thereby the operability in an operation of inputting a character string to be printed can be increased.

Furthermore, in the tape printer 1 according to the embodiment, the third top surface 173*a*, which is the key top of the third key 173, is convex.

With this structure, an area where the third top surface 173*a* comes into contact with a finger is reduced compared with a case where the third top surface 173*a* is flat or concave. Consequently, when a user operates the third keys 173 with a finger, the user's tactile experience can be increased.

Furthermore, the tape printer 1 according to the embodiment includes the first frame member 191, which surrounds the power key 17*a*, and the second frame member 192, which surrounds the print key 17*e*.

With this structure, the first frame member 191 reduces the chance that a key-operating object may touch the power key 17*a*, and the second frame member 192 reduces the chance that a key-operating object may touch the print key 17*e*. Accordingly, users are further effectively prevented from accidentally operating the power key 17*a* and the print key 17*e*.

The tape printer 1 according to the embodiment can be operated while the tape printer 1 is being held by a user. With this structure, users are prevented from accidentally operating the power key 17*a* and the print key 17*e* when a user operates the tape printer 1 while holding the tape printer 1 by hand.

It is to be understood that the present invention is not limited to the above-described embodiment, various modifications can be made without departing from the scope of the invention. For example, this embodiment can be modified as described below.

Although the second keys 172 include the power key 17*a* and the print key 17*e*, the second keys 172 may include only the power key 17*a*. In other words, the height of the protrusion of the power key 17*a* with respect to the operation surface 18 may be lower than the height of the protrusions of the first keys 171 with respect to the operation surface 18, and the height of the protrusion of the print key 17*e* with respect to the operation surface 18 may be equal to or higher than the height of the protrusions of the first keys 171 with respect to the operation surface 18. Similarly, the second keys 172 may include only the print key 17*e*. That is, the height of the protrusion of the print key 17*e* with respect to the operation surface 18 may be lower than the height of the protrusion of the first key 171 with respect to the operation surface 18, and the height of the protrusion of the power key 17*a* with respect to the operation surface 18 may be equal to or higher than the height of the protrusions of the first keys 171 with respect to the operation surface 18.

In addition to the power key 17*a* and the print key 17*e*, the second keys 172 may include other operation keys 17, for example, the second keys 172 may include the preview key 17*b*. Similarly, in addition to the character keys 17*g*, the third keys 173 may include the other operation keys 17. For example, it is preferable that the third keys 173 include operation keys 17 that are relatively frequently used such as the shift key 17*i* and the space key 17*j*.

Although the character keys 17*g* are included in the third keys 173, the character keys 17*g* may be included in the first keys 171 or in the second keys 172. In other words, the height of the protrusions of the character keys 17*g* with respect to the operation surface 18 may be equal to the height of the protrusions of the first keys 171 with respect to the operation surface 18, or may be equal to the height of the protrusions of the second keys 172 with respect to the operation surface 18.

Although the operation keys 17 are classified into the three groups of the first keys 171, the second keys 172, and the third keys 173 according to the differences in the heights of the protrusions with respect to the operation surface 18, the operation keys 17 may be classified into two groups of the first keys 171 and the second keys 172, or into four groups or more.

Although the operation surface 18 on which the operation keys 17 are provided is only the +Z side surface of the apparatus case 11, for example, the operation surface 18 may be provided on the +Z side surface of the apparatus case 11 and the +Z side surface of the cover 12. That is, part of the operation keys 17 may be provided on the cover 12. In such a case, it is preferable that the +Z side surface of the apparatus case 11 be substantially flush with the +Z side surface of the cover 12 when the cover 12 is closed.

Although the first top surface 171*a* and the second top surface 172*a* are flat, the first top surface 171*a* and the second top surface 172*a* may be convex or concave. Furthermore, although the third top surface 173*a* is convex, the third top surface 173*a* may be concave.

Although the height of the protrusions of the first frame member 191 and the second frame member 192 with respect to the operation surface 18 is lower than the height (h2) of the protrusions of the power key 17*a*, which is surrounded by the first frame member 191, and the print key 17*e*, which is surrounded by the second frame member 192, with respect to the operation surface 18, the height of the protrusions of the first frame member 191 and the second frame member 192 with respect to the operation surface 18 may be equal to the protrusion height (h2) or higher than the protrusion height (h2).

This application claims priority under 35 U.S.C. § 119 to Japanese Patent Application No. 2016-078236, filed Apr. 8, 2016. The entire disclosure of Japanese Patent Application No. 2016-078236 is hereby incorporated herein by reference.

What is claimed is:

1. A tape printing apparatus comprising:

an operation surface; and a plurality of operation keys protruding from the operation surface;

wherein the operation keys include:

first keys; and second keys that protrude less than the first keys from the operation surface, and the second keys include at least one of a power key and a print key.

2. The tape printing apparatus according to claim 1, wherein the operation keys further include:

third keys that protrude more than the first keys from the operation surface, and the third keys include character keys.

3. The tape printing apparatus according to claim 2, wherein a key top of each of the third keys is convex.

4. The tape printing apparatus according to claim 1, further comprising:

at least one of a frame member that surrounds the power key and a frame member that surrounds the print key.

5. The tape printing apparatus according to claim 1, wherein the tape printing apparatus can be held and operated by hand.

* * * * *